US005166659A

United States Patent [19]

Navarro

[11] Patent Number: 5,166,659

[45] Date of Patent: Nov. 24, 1992

[54] HEARING AID WITH CERUMEN COLLECTION CAVITY

[76] Inventor: Marvin R. Navarro, 8966 Kiser Point, Indianapolis, Ind. 46256

[21] Appl. No.: 612,075

[22] Filed: Nov. 9, 1990

[51] Int. Cl.[5] ..... H04R 25/00

[52] U.S. Cl. ..... 381/68.6; 381/68.5; 381/69; 181/130; 181/135

[58] Field of Search ..... 381/68.6, 69, 68.5, 381/68.4; 181/130, 135

[56] References Cited

U.S. PATENT DOCUMENTS

| | | | |
|---|---|---|---|
| 3,983,336 | 9/1976 | Malek | 381/68.6 |
| 4,311,206 | 1/1982 | Johnson | 181/135 |
| 4,520,236 | 5/1985 | Gauthier | 381/69 |
| 4,706,778 | 11/1987 | Topholm | 381/68.6 |
| 4,800,982 | 1/1989 | Carlson | 381/68.6 |
| 4,879,750 | 11/1989 | Nassler | 381/68.6 |
| 4,972,492 | 11/1990 | Tanaka | 381/68.6 |

*Primary Examiner*—Jin F. Ng
*Assistant Examiner*—Christine K. Oda
*Attorney, Agent, or Firm*—Woodard, Emhardt, Naughton, Moriarty & McNett

[57] ABSTRACT

An improved hearing aid that reduces occlusion caused by the accumulation of ear wax includes a hearing aid body, an amplifier disposed within the hearing aid body, and an ear canal body adapted for insertion in the auditory canal of a human ear. The ear canal body has a deep transverse groove about 1 mm to 5 mm in width to form a cavity that is accessible to clear ear wax buildup in the cavity. A first passageway from the amplifier to one side of the cavity provides a conduit for sound to travel from the amplifier to the cavity. An end portion of the ear canal body forms a plow to divert ear wax as it is inserted into the auditory canal. The plow portion is of a cross sectional area substantially equal to the auditory canal. The plow portion has a second passageway that joins the cavity and the end of the ear canal body closest the ear drum. The second passageway is larger in diameter than the first passageway and its central axis is offset from the central axis of the first passageway.

49 Claims, 5 Drawing Sheets

HEARING AID WITH CERUMEN COLLECTION CAVITY

BACKGROUND OF THE INVENTION

1. Field of the Invention

The field of this invention is devices used as hearing aids that are placed in the auditory canal More specifically, the invention is an improvement that relates to the problem of ear wax accumulation in a hearing aid.

2. Description of the Prior Art

Many hearing aids have an ear canal body that is inserted in the auditory canal of the ear. These hearing aids have an amplification means which is typically an electronic receiver that amplifies the volume of sound. Typically they are powered by a small battery.

A person is fitted for an ear canal body by measuring the person's ear and auditory canal. The measurement is typically done by taking an impression of the ear and auditory canal. The impression is then used to form a mold. The mold is then used to form an ear canal body that will fit snugly in the auditory canal of that person. One end of the ear canal body will be near the ear drum of the person. The other end of the hearing aid is usually at the entrance of the auditory canal and it houses the amplification means. The prior art ear canal body had a tubular passageway that ran from the amplification means to the end of the ear canal body near the ear drum. The amplified sound from the amplification means went through this tubular passageway to the ear drum.

The auditory canal of an ear naturally accumulates a substance that is generally known as ear wax or cerumen. Some individuals accumulate ear wax at a greater rate than others. This natural accumulation of ear wax has been a problem for hearing aid design. In the known design of hearing aids, the ear wax accumulation enters the tubular passageway. This initial accumulation degrades the performance of the hearing aid because it clogs the tubular passageway. As accumulation continues, a greater problem may occur because the ear wax travels through the tubular passageway until it reaches the electronic amplification means. In many instances the ear wax reaching the amplification means can ruin the receivers and thus stop the functioning of the hearing aid. In those cases the person must go to the expense and inconvenience of having the hearing aid either repaired or replaced.

The problem of ear wax occlusion of hearing aids has been addressed by several alternatives. One alternative is for the user to periodically remove the hearing aid and clean it before substantial buildup of ear wax can occur. However, users typically prefer to keep their hearing aids in place for extended periods. Some users' ears build up ear wax so quickly that they need to clean the hearing aid very frequently. Users often neglect proper maintenance. Accordingly, other alternatives have been used. The inventor is aware of the following:

1. The Wax Screw: A screw is threaded into the tubular passageway. The screw has a central bore. The user periodically removes the screw to clean out the ear wax from its central bore.

2. The Mesh Screen: A fine mesh screen or grid is placed over the entrance of the tubular passageway to prevent the entry of ear wax into the passageway. When the screen fills with ear wax it may need cleaning or replacement.

3. Add On Rib: The two ends of a clear plastic thin rib are glued to the ear canal body that is nearest the ear drum. The rib is intended to break up the ear wax as the ear canal body is inserted in the auditory canal. The rib may cause discomfort or may break off. Ear wax still reaches the tubular passageway and must be cleaned from the passageway.

4. The Sponge Filter: A sponge type material is inserted in the tubular passageway's opening near the ear drum. The sponge absorbs the ear wax or stops it from entering the passageway. Periodically the sponge must be removed and replaced.

5. Ear Wax Sleeve: A sleeve is placed in the tubular passageway. When the sleeve fills with ear wax it is removed and replaced by a clean sleeve.

The present invention, as described herein, is a different approach than the prior art to the wax accumulation problem. The present invention provides for an improved hearing aid that reduces the problem of ear wax occlusion and also allows for easy cleaning of the hearing aid to prevent undue buildup.

SUMMARY OF THE INVENTION

The present invention is an improved hearing aid and a method for making such a hearing aid. The invention provides for a hearing aid that reduces ear wax occlusion and allows for easy cleaning of ear wax. More particularly, the invention is summarized as a hearing aid comprising: a hearing aid body having an ear canal body adapted for insertion in the auditory canal of an ear; the ear canal body having a cavity or groove defined by said ear canal body or by the ear canal body and a plow member joined to the ear canal body; amplification means for increasing the volume of sound, the amplification means being in the hearing aid body; the ear canal body defines a first amplification passageway having a first amplification opening adjacent the amplification means and a second amplification opening which opens into the cavity; the ear canal body or the plow member defines a second amplification passageway having a third amplification opening which opens into the cavity and a fourth amplification opening located on the surface of the ear canal body; and cavity access means adjacent the cavity for access to the cavity to remove ear wax from the cavity.

The advantages and improvements of this invention will be appreciated from a review of the following drawings and detailed description.

DESCRIPTION OF THE PREFERRED EMBODIMENT

Figure 1:
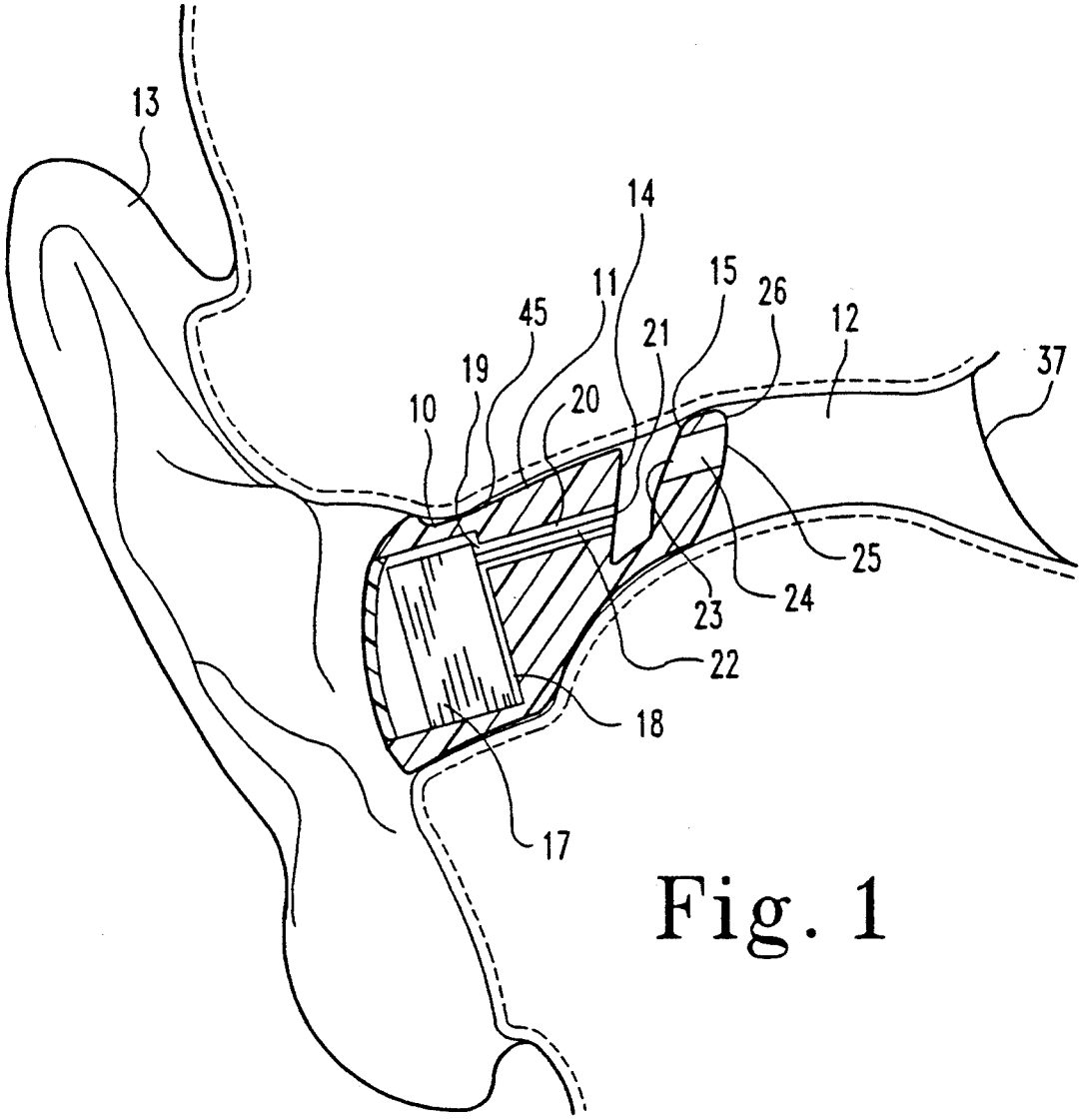
FIG. 1 is a side view of the preferred embodiment of the hearing aid of the present invention as it would be placed in the auditory canal of a human ear. The view is in cross section.
Figure 2:
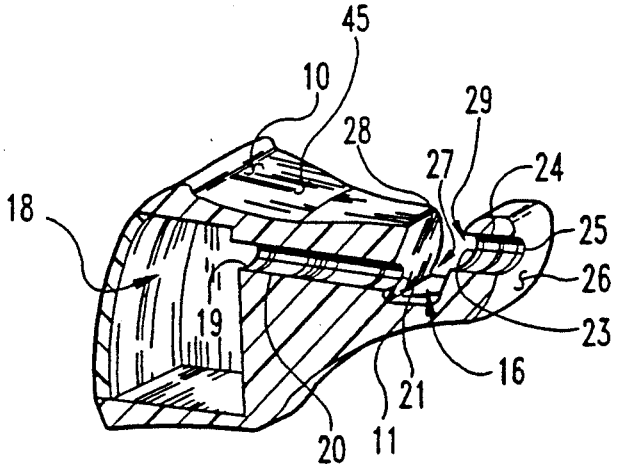
FIG. 2 is a perspective view of the preferred embodiment of the hearing aid of the present invention. The view is in cross section through the center of the hearing aid.
Figure 3:
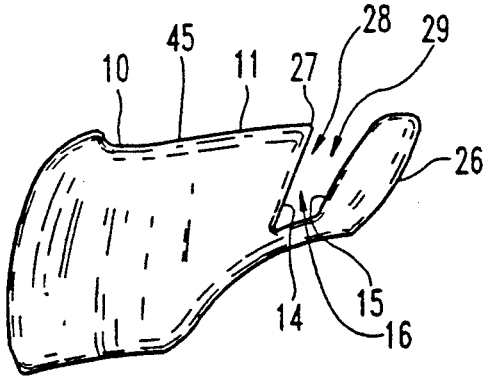
FIG. 3 is a side elevational view of the preferred embodiment of the hearing aid of the present invention.
Figure 4:
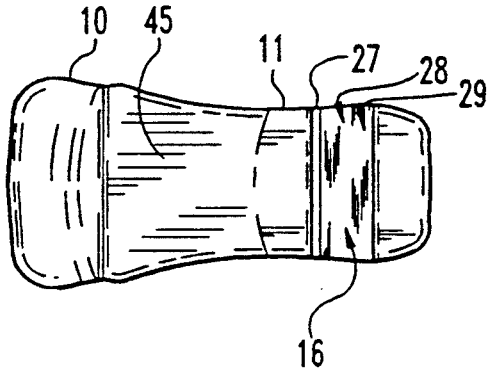
FIG. 4 is a top elevational view of the preferred embodiment of the hearing aid of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 11:
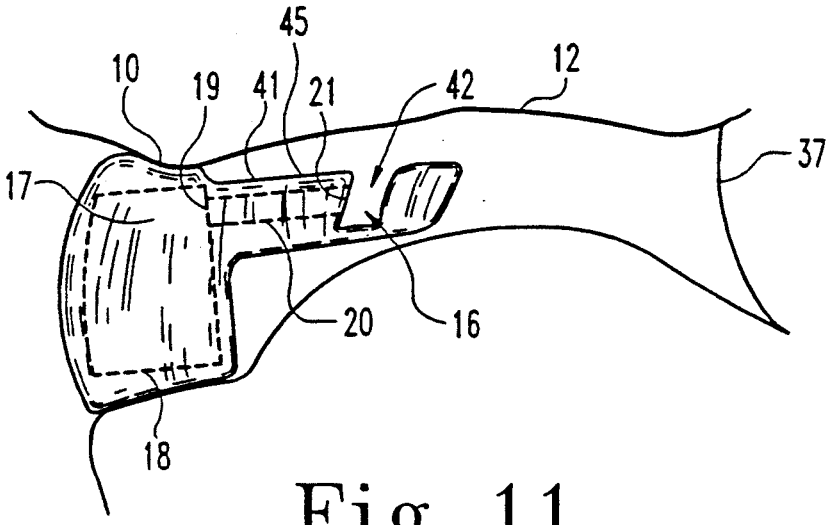
FIG. 11 is a side elevational view of another alternative embodiment of the hearing aid of the present invention as it would be placed in the auditory canal of a human ear. The internal passageways and cavity that cannot be seen from the side are shown in outline form.
Figure 12:
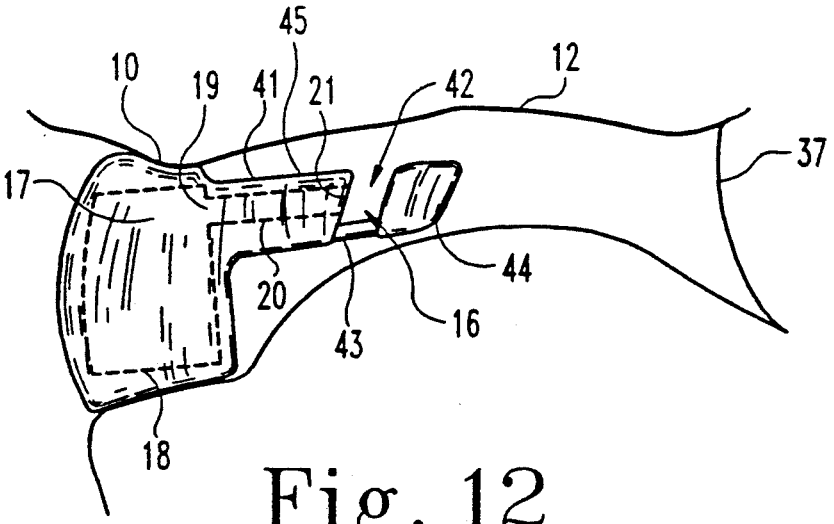
FIG. 12 is a side elevational view of another alternative embodiment of the hearing aid of the present invention as it would be placed in the auditory canal of a human ear. The internal passageways and cavity that cannot be seen from the side are shown in outline form.

The presently preferred embodiment of the improved hearing aid of the present invention will now be described. FIG. 1 shows the hearing aid body 10 and its ear canal body 11 in the auditory canal 12 of a human ear 13. In the preferred embodiment the ear canal body 11 has a cross sectional area that is substantially equal to the cross sectional area of the auditory canal 12 so that the ear canal body 11 is adapted to be received in the auditory canal 12. The fit between the auditory canal 12 and the ear canal body 11 outer surface is typically snug. However, the ear canal body 11 can also be adapted to be inserted into the auditory canal 12 in situations where the cross sectional area of the ear canal body 41 is less than the cross sectional area of the auditory canal 12. See FIG. 11 and FIG. 12. As is known to the art, the ear canal body 41 of FIG. 11 and FIG. 12 is used in certain persons that require certain sound characteristics that are best met by a smaller ear canal body 41. The range of fits of ear canal bodies adapted for insertion in the auditory canal is known to those in the art of hearing aid design.

In the preferred embodiment the ear canal body 11 defines a cavity 16 with its side walls 14 and 15. The cavity 16 in the preferred embodiment is created by a groove that is cut into the ear canal body 11. The cavity 16 and its relationship to this invention will be further explained hereafter once the other components of the hearing aid invention are identified.

The hearing aid body 10 defines an amplification means cavity 18 in which is housed an amplification means 17. The amplification means 17 can be any of a wide variety of electronic amplification devices that are known or will become known to the art. The amplification means 17, as is known to the art, receives sound and then increases its volume. Amplification means may be battery powered and they may have volume controls. Many amplification means have an amplification tube through which they guide the sound of increased volume.

In the preferred embodiment of the present invention the amplification tube 22 extends from the amplification means 17 into a first amplification opening 19 that is adjacent the amplification means 17. The first amplification opening 19 leads into a first amplification passageway 20 which is defined by the ear canal body. The amplification tube 22 extends through the first amplification passageway 20 until it reaches the second amplification opening 21 at the opposite end of the first amplification opening 20. At this point, in the preferred embodiment, the amplification tube 22 does not extend beyond the second amplification opening 21. The second amplification opening, as shown in FIG. 1, opens into the cavity 16 because it is disposed on wall 14 of the groove of ear canal body 11.

The preferred embodiment of the present invention has a second amplification passageway 24 defined by the ear canal body 11. The second amplification passageway 24 has a third amplification opening 23 which opens into the cavity 16 and is located on wall 15 of the groove. The opposite opening of the second amplification passageway 24 is fourth amplification opening 25 that is located on the end surface of the ear canal body 26 which is disposed nearest the ear drum 37. The body 11 has a lateral surface 45.

Figure 5:
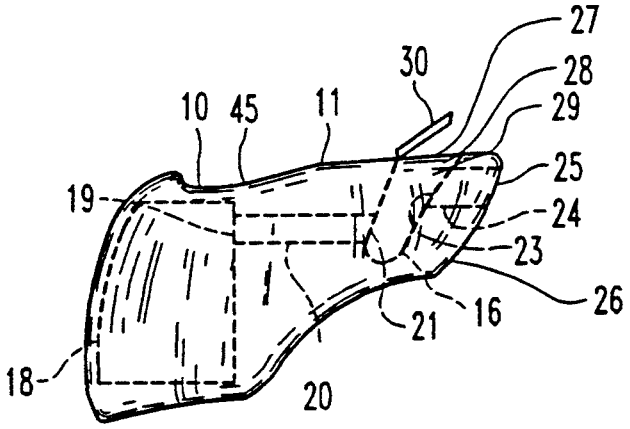
FIG. 5 is a side elevational view of an alternative embodiment of the hearing aid of the present invention. The internal passageways and cavities that cannot be seen from the side are shown in outline form.
Figure 6:
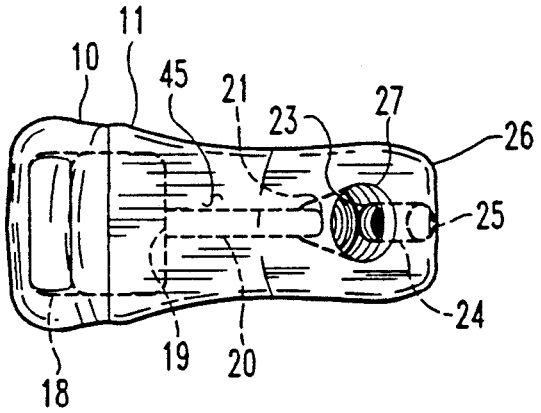
FIG. 6 is a top elevational view of the alternative embodiment of the hearing aid of the present invention that is depicted in FIG. 5 with the exception that the door means 30 is not included in this figure. The internal passageways and cavity that cannot be seen from the top are shown in outline form.

Adjacent to the cavity 16 are cavity access means for allowing access to the cavity to remove ear wax from the cavity 16. In the preferred embodiment, the cavity access means are accomplished with a groove in the ear canal body 11 as shown in FIG. 1, FIG. 2, FIG. 3, FIG. 4, FIG. 7 and FIG. 8. This groove has a first access opening 27 on the surface of the ear canal body 11. In other words, because there is a groove having walls 14 and 15 cut into ear canal body 11, the initial part of the groove is an opening in the ear canal body 11. As we descend further into the groove beyond the first access opening 27 the groove is an access passageway 28. Further down, the groove is effectively a second access opening 29 into the cavity 16. FIG. 5 and FIG. 6 depict an alternative embodiment of the present invention and its cavity access means. In those figures the cavity 16 is part of a bore that has been made from the surface of the ear canal body 11 into its internals. The cavity 16 in FIG. 5 and FIG. 7 has an cavity access means of a first access opening 27 at the top of the bore, an access passageway 28 as we descend through the bore, and a second access opening 29 into the cavity 16. FIG. 5 also shows the alternative of including a door means over the first access opening 27. The cross sectional area of the cavity and the access openings and passageways in the preferred embodiment is larger than the cross sectional area of the first amplification passageway 20. This means that the cavity 16 and the access to it provide a larger channel through which ear wax buildup may be removed.

Figure 7:
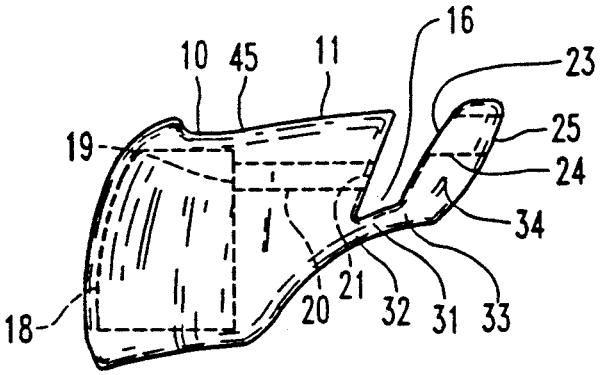
FIG. 7 is a side elevational view of another alternative embodiment of the hearing aid of the present invention. The internal passageways and cavity that cannot be seen from the side are shown in outline form.
Figure 8:
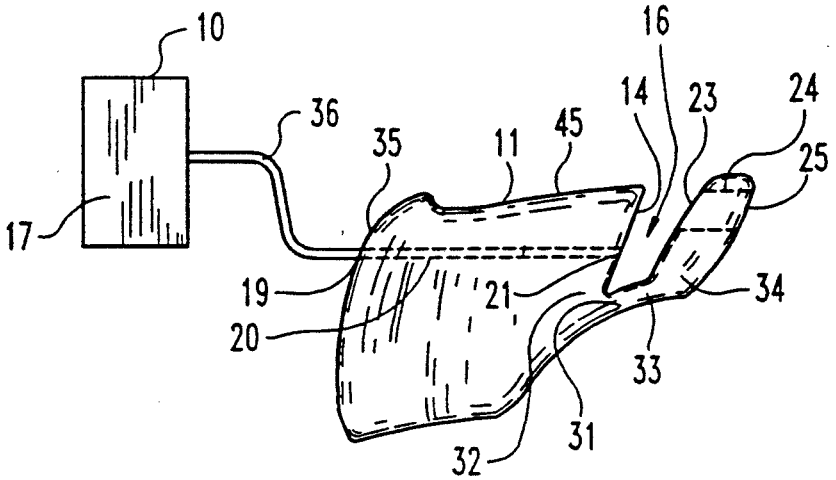
FIG. 8 is a side elevational view of another alternative embodiment of the hearing aid of the present invention. The internal passageways and cavity that cannot be seen from the side are shown in outline form.

The construction of the preferred embodiment of the present invention can also be described or achieved by use of a plow joining member 31 and a plow member 34 as shown in FIG. 7 and 8. In such an embodiment, a plow joining member 31 has a cross sectional area smaller than the auditory canal 12. One end 32 of the plow joining member 32 is joined, attached or otherwise connected to the ear canal body 11. The other end 33 of the plow joining member is joined, attached or otherwise connected to the plow member 34. The plow member 34 has a cross sectional area that is substantially equal to the auditory canal's cross sectional area at the point at which the plow member will reside once the hearing aid is inserted. Thus the plow member 34 fills the auditory canal 12 in cross section. The plow member 34 has a second amplification passageway 24 with opposing openings 23 and 25 as shown in FIG. 7.

In the preferred embodiment of the present invention the second amplification opening 21 and the third amplification opening 23 are offset from one another. One means of offset is to place them on different central axis. In the preferred embodiment the offset is such that when a vertical plane is drawn perpendicular to openings 21 and 23 and an imaginary tube is extended from each opening to that plane the tubes will not intersect. This offset reduces the likelihood that ear wax coming through opening 23 will reach opening 21. Further, in the preferred embodiment opening 21 is spaced apart from opening 23 by a distance between 1 mm to 5 mm. A spacing having a distance less than 1 mm or greater than 5 mm is also available within the confines of the size of the auditory canal of the individual. Other offsets, no offset or other spacings are included in the concept of this invention.

In an additional alternative embodiment, shown in FIG. 8, the hearing aid body 10 containing the amplification means 17 may be disposed a distance from the ear canal body 11. In such a case, a sound transfer means such as tube 36 is employed to guide sound from the amplification means 17 to the first amplification passageway 20 in the ear canal body 11.

As can be discerned from the construction and concept of the present invention, cavity 16 and the cavity access means are accomplished with numerous structures and shapes. The cavity 16 serves to separate the opening 21 from opening 23 and thus provides an interim receptacle or repository for ear wax accumulation before it enters the passageway 20 that leads to the amplification means 17. Increasing the size of the cavity allows greater accumulation in this area before ear wax will enter the much smaller passageway 20 that leads to the amplification means.

The cavity access means allows the user to easily clear the cavity of ear wax buildup. In the embodiment that uses a groove, as in FIG. 1, the user can take a brush and clear the groove of ear wax. The second passageway 24 with openings 23 and 25 is made larger in cross section than the first passageway 20 and openings 19 and 21. The larger passageway 24 allows ear wax to enter and fall into the cavity 16 and thus lessens the occlusion of the second passageway 24. Consequently, the amplified sound goes from the amplification means 17 through passageway 20 to cavity 16 then through passageway 24 to the auditory canal 12 and ear drum 37.

When the hearing aid is inserted, ear wax is initially plowed out of the way by plow 34 or the front of ear canal body 26. To the extent any ear wax enters passageway 24 it passes through because of the larger size of the passageway. Ear wax accumulates in cavity 16. Before substantial ear wax has accumulated in cavity 16 the user has likely had occasion to remove the hearing aid. The user is more likely to notice the unsightly ear wax buildup in the exposed groove or cavity and to brush it out on a regular basis. Thus, the present invention also sponsors more conscientious maintenance by the user. Such maintenance will prevent the wax buildup in cavity 16 from reaching a point where it will begin to backup into passageway 20.

Figure 9:
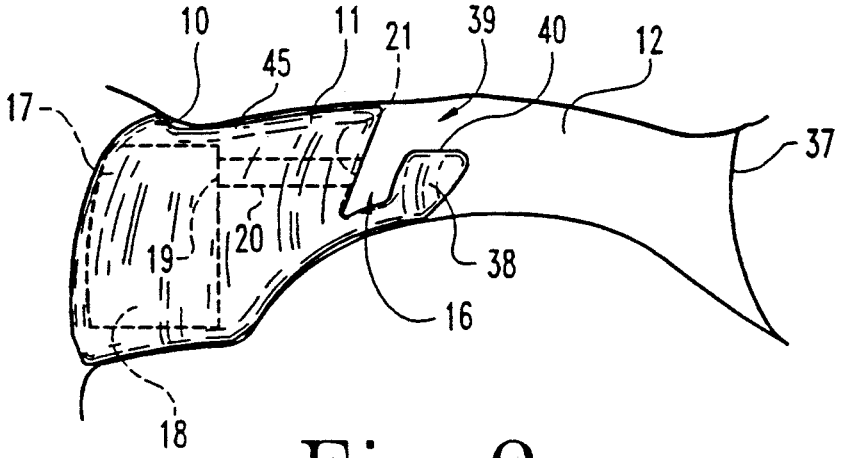
FIG. 9 is a side elevational view of another alternative embodiment of the hearing aid of the present invention as it would be placed in the auditory canal of a human ear. The internal and cavity that cannot be seen from the side are in outline form.
Figure 10:
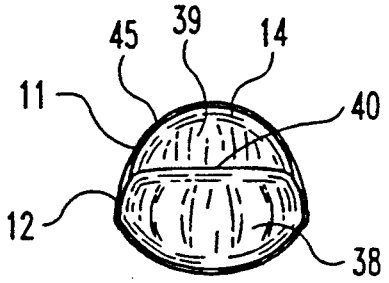
FIG. 10 is a end elevational view of the alternative embodiment of FIG. 9 as it would be placed in the auditory canal of a human ear.

An alternative embodiment of the plow member is shown in FIG. 9 and FIG. 10. In that embodiment the plow member 38 is made so that its cross sectional area is less than the cross sectional area of the auditory canal 12. A gap 39 thus exists between the plow member's outer circumference 40 and the walls of the auditory canal. Sound from the amplification means 17 is guided through passageway 20 through opening 21 onto an exterior surface of the ear canal body, through cavity 16 and through gap 39 to the auditory canal and ear drum 37. Ear wax is initially plowed out of the way by plow member 38. Ear wax that comes through gap 39 again accumulates in cavity 16 before it enters passageway 20. Ear wax can be readily cleaned out from cavity 16 as described above.

Another alternative embodiment is as shown in FIG. 11 and FIG. 12. In those embodiments the ear canal body 41 has a cross sectional area less than the auditory canal 12. The cavity 16 is part of a groove 42 cut in the end of the ear canal body. The groove 42 can alternatively be achieved by attaching a plow joining member 43 to the end of the ear canal body 41 as shown in FIG. 12 and then attaching a plow member 44 to the end of the plow joining member as shown in FIG. 12. The cavity 16 in these embodiments may be made in a variety of shapes and sizes. The plow member 44 may or may not have a second amplification passageway bored through it. The plow member 44 is made to have a cross sectional area smaller than the auditory canal so that sound will be guided around the plow member 44.

It should be noted that the cavity 16 can be made in a number of shapes and sizes that are contemplated by this invention. The cavity access means can also be a bore, a tunnel to the cavity, or an open area as in the case of the groove embodiment. It should be noted that the figures disclose various groove or cavity structures where the access opening is towards the top of the auditory canal. It is to be understood that the cavity and its access opening may be orientated towards the bottom of the auditory canal or any other direction. To the extent such variations employ the concepts of this invention they form a part of this invention.

In addition to the advantages of this invention there is a method for its construction that improves upon existing hearing aid construction methods. As already described, the ear canal body is formed by first taking an impression of the auditory canal and ear. This impression is used as a blank to create a mold. Plastic is then molded to conform to the shape of the blank thus creating an ear canal body that fits, as is known, in the auditory canal of the user. When the initial ear canal body is molded it is typically a solid unit that has an outer surface in conformance with the inner surface of the auditory canal. In the preferred embodiment of the method of the present invention, the end of the ear canal body that is to have the groove is molded so that it is 2 mm to 3 mm longer than is typically used. A bore is made in the material of the ear canal body for the first passageway 20 from the amplification means cavity 18 all the way to the end 26 of the ear canal body 11. A groove is then cut in the ear canal body so that the groove intersects what will be the end 21 of the first passageway 20. A second passageway 24 larger in diameter than and offset from the first passageway 20 is then bored from the cavity 16 of the groove to the end 26 of the ear canal body 11. Then the amplification tube of the amplification means 17 is thread through the passageway 20 so that the end of the tube is at opening 21. Where a conventional tube is used that has a longer length, the tube would be thread through the entire passageway and then cut at opening 21. The tube is glued to passageway 20 in the conventional manner of using silicon glue coating the tube before it is thread into the passageway 20. The final step is to fill in with plastic the portion of the bore for passageway 20 that runs from the end 26 of the ear canal member 11 to the cavity 16. An alternative method is to cut the groove first and then bore the passageways. It should also be noted that if the tube being used is pre cut or sized then the bore for the first passageway can be run to a point short of the end of the ear canal body 11 and thus eliminate the step of filling in the extra length of bore. A further alternative is to not bore the second passageway 24 but instead remove some of the material of the plow portion so that it does not fill the entire cross section of the auditory canal. This construction results in a plow member 38 as shown in FIG. 9 and FIG. 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention, or that are equivalents, are desired to be protected.

What is claimed is:

1. A hearing aid comprising:

a hearing aid body having an ear canal body adapted for insertion in the auditory canal of an ear, said ear canal body having a lateral surface and an end surface;

said ear canal body having an externally accessible cavity defined by said ear canal body and located on the lateral surface of said ear canal body;

amplification means for increasing the volume of sound, said amplification means being in said hearing aid body;

said ear canal body defining a first amplification passageway having a first amplification opening adjacent said amplification means and a second amplification opening which opens into said cavity;

said ear canal body defining a second amplification passageway having a third amplification opening which opens into said cavity and a fourth amplification opening located on the end surface of said ear canal body; and said ear canal body defining an access passageway having a first access opening located on the lateral surface of said ear canal body and a second access opening which opens into said cavity.

2. The hearing aid of claim 1 wherein said ear canal body having a cross sectional area substantially equal to a cross sectional area of said auditory canal.

3. The hearing aid of claim 1 wherein said ear canal body having a cross sectional area smaller than a cross sectional area of said auditory canal.

4. The hearing aid of claim 2 wherein said access passageway having a cross sectional area larger than a cross sectional area of said first amplification passageway.

5. The hearing aid of claim 3 wherein said access passageway having a cross sectional area larger than a cross sectional area of said first amplification passageway.

6. The hearing aid of claim 4 wherein the axis of said second amplification opening being offset from the axis of said third amplification opening.

7. The hearing aid of claim 5 wherein the axis of said second amplification opening being offset from the axis of said third amplification opening.

8. The hearing aid of claim 6 wherein said second amplification passageway having a cross sectional area larger than a cross sectional area of said first amplification passageway.

9. The hearing aid of claim 7 wherein said second amplification passageway having a cross sectional area larger than a cross sectional area of said first amplification passageway.

10. The hearing aid of claim 8 wherein said second amplification opening being spaced from said third amplification opening by a distance between 1 mm to 5 mm.

11. The hearing aid of claim 9 wherein said second amplification opening being spaced from said third amplification opening by a distance between 1 mm to 5 mm.

12. The hearing aid of claim 2 wherein the axis of said second amplification opening being offset from the axis of said third amplification opening.

13. The hearing aid of claim 3 wherein the axis of said second amplification opening being offset from the axis of said third amplification opening.

14. The hearing aid of claim 2 wherein said ear canal body includes door means for selectably closing or opening the access to said first access opening.

15. The hearing aid of claim 3 wherein said ear canal body includes door means for selectably closing or opening the access to said first access opening.

16. The hearing aid of claim 2 wherein said amplification means includes an amplification tube, said tube enters said first amplification passageway at said first amplification opening and said tube only extends to said second amplification opening.

17. The hearing aid of claim 3 wherein said amplification means includes an amplification tube, said tube enters said first amplification passageway at said first amplification opening and said tube only extends to said second amplification opening.

18. A hearing aid comprising:

a hearing aid body having an ear canal body including a lateral surface and an end surface and which is adapted for insertion it eh auditory canal of an ear;

said ear canal body having a cavity defined by the lateral surface of said ear canal body;

amplification means for increasing the volume of sound, said amplification means being in said hearing aid body;

said ear canal body defining a first amplification passageway having a first amplification opening adjacent said amplification means and a second amplification opening which opens into said cavity; and cavity access means adjacent said cavity for access to said cavity to remove ear wax from said cavity.

19. The hearing aid of claim 18 wherein said ear canal body having a cross sectional area substantially equal to a cross sectional area of said auditory canal.

20. The hearing aid of claim 19 wherein said cavity access means includes a cavity access passageway having a cross sectional area larger than a cross sectional area of said first amplification passageway.

21. The hearing aid of claim 19 wherein said ear canal body defining a second amplification passageway having a third amplification opening which opens into said cavity and a fourth amplification opening located on the surface of said ear canal body.

22. The hearing aid of claim 21 wherein the axis of said second amplification opening being offset from the axis of said third amplification opening.

23. The hearing aid of claim 22 wherein said second amplification passageway having a cross sectional area larger than a cross sectional area of said first amplification passageway.

24. The hearing aid of claim 21 wherein said cavity access means includes a cavity access passageway having a cross sectional area larger than a cross sectional area of said first amplification passageway.

25. The hearing aid of claim 21 wherein said second amplification opening being spaced from said third amplification opening by a distance between 1 mm to 5 mm.

26. The hearing aid of claim 18 wherein said ear canal body having a cross sectional area smaller than a cross sectional area of said auditory canal.

27. The hearing aid of claim 26 wherein said cavity access means includes a cavity access passageway having a cross sectional area larger than a cross sectional area of said first amplification passageway.

28. A hearing aid comprising:

a hearing aid body having an ear canal body adapted for insertion in the auditory canal of an ear;

said ear canal body having a groove defined by the lateral surface of said ear canal body, said groove extending transversely with respect to the auditory canal;

amplification means for increasing the volume of sound, said amplification means being in said hearing aid body;

said ear canal body defining a first amplification passageway having a first amplification opening adjacent said amplification means and a second amplification opening which opens into said groove.

29. The hearing aid of claim 28 wherein said ear canal body having a cross sectional area substantially equal to a cross sectional area of said auditory canal.

30. The hearing aid of claim 29 wherein said ear canal body defining a second amplification passageway having a third amplification opening which opens into said groove and a fourth amplification opening located on the surface of said ear canal body.

31. The hearing aid of claim 30 wherein the axis of said second amplification opening being offset from the axis of said third amplification opening.

32. The hearing aid of claim 31 wherein said second amplification passageway having a cross sectional area larger than a cross sectional area of said first amplification passageway.

33. The hearing aid of claim 30 wherein said second amplification opening being spaced from said third amplification opening by a distance between 1 mm to 5 mm.

34. The hearing aid of claim 28 wherein said ear canal body having a cross sectional area smaller than a cross sectional area of said auditory canal.

35. The hearing aid of claim 34 wherein said groove having a width between 1 mm and 5 mm.

36. A hearing aid comprising:

a hearing aid body;

an ear canal body connected to said hearing aid body, said ear canal body being adapted for insertion in the auditory canal of an ear;

a plow joining member having a first end and a second end, said first end being connected to said ear canal body, said plow joining member having a cross sectional area smaller than a cross sectional area of said ear canal body, said plow joining member extending away from said ear canal body and said second end being spaced apart from said ear canal body;

a plow member having a cross sectional area larger than a cross sectional area of said plow joining member, said plow member being connected to said second end of said plow joining member, and said plow member being spaced apart from said ear canal body;

amplification means for increasing the volume of sound, said amplification means being in said hearing aid body; and said ear canal body defining a first amplification passageway having a first amplification opening adjacent said amplification means and a second amplification opening which is located on an exterior surface of said ear canal body.

37. The hearing aid of claim 36 wherein said plow member having a cross sectional area substantially equal to a cross sectional area of said auditory canal; and said plow member defining a second amplification passageway having a third amplification opening on a first side of said plow member and a fourth amplification opening on a second opposite side of said plow member.

38. The hearing aid of claim 37 wherein the axis of said second amplification opening being offset from the axis of said third amplification opening.

39. The hearing aid of claim 38 wherein said second amplification passageway having a cross sectional area larger than a cross sectional area of said first amplification passageway.

40. The hearing aid of claim 37 wherein said second amplification opening being spaced from said third amplification opening by a distance between 1 mm to 5 mm.

41. The hearing aid of claim 36 wherein said plow member having a cross sectional area smaller than a cross sectional area of said auditory canal thereby defining a gap between the outer circumference of said plow member and the wall of said auditory canal when said plow member is in said auditory canal.

42. The hearing aid of claim 41 wherein said second amplification opening being spaced from said plow member by a distance between 1 mm to 5 mm.

43. A hearing aid comprising:

a hearing aid body having an amplification means for increasing the volume of sound;

an ear canal body adapted for insertion in the auditory canal of an ear, said ear canal body defining a first amplification passageway having a first opening at a first surface of said ear canal body and a second opening at a second surface of said ear canal body;

sound transfer means for guiding sound from said amplification means to said first opening of said first amplification passageway;

a plow joining member having a first end and a second end, said first end being connected to said ear canal body, said plow joining member having a cross sectional area smaller than a cross sectional area of said ear canal body, said plow joining member extending away form said ear canal body and sad second end being spaced apart from said ear canal body; and a plow member having a cross sectional area larger than a cross sectional area of said plow joining member, said plow member being connected to said second end of said plow joining member.

44. The hearing aid of claim 43 wherein said plow member having a cross sectional area substantially equal to a cross sectional area of said auditory canal; and said plow member defining a second amplification passageway having a third amplification opening on a first side of said plow member and a fourth amplification opening on a second opposite side of said plow member.

45. The hearing aid of claim 44 wherein the axis of said second amplification opening being offset from the axis of said third amplification opening.

46. The hearing aid of claim 45 wherein said second amplification passageway having a cross sectional area larger than a cross sectional area of said first amplification passageway.

47. The hearing aid of claim 44 wherein said second amplification opening being spaced from said third amplification opening by a distance between 1 mm to 5 mm.

48. The hearing aid of claim 43 wherein said plow member having a cross sectional area smaller than a cross sectional area of said auditory canal thereby defining a gap between the outer circumference of said plow member and the wall of said auditory canal when said plow member is in said auditory canal.

49. The hearing aid of claim 48 wherein said second amplification opening being spaced from said plow member by a distance between 1 mm to 5 mm.

* * * * *